United States Patent [19]

Davis et al.

[11] Patent Number: 4,616,458

[45] Date of Patent: Oct. 14, 1986

[54] PROTECTIVE APPARATUS FOR TENDONS IN TENDON TENSIONING ANCHOR ASSEMBLIES

[75] Inventors: Edgar A. Davis, San Jose; Rose M. Dexter, Los Gatos; John D. McCarthy, San Jose, all of Calif.

[73] Assignee: VSL Corporation, Los Gatos, Calif.

[21] Appl. No.: 750,293

[22] Filed: Jul. 1, 1985

[51] Int. Cl.[4] ..... E04C 3/26; E04C 5/08

[52] U.S. Cl. ..... 52/230; 52/223 L

[58] Field of Search ..... 52/223 L, 223, 230

[56] References Cited

U.S. PATENT DOCUMENTS

| | | | |
|---|---|---|---|
| 2,930,642 | 3/1960 | Howlett . | |
| 3,212,222 | 10/1965 | Wittfoht . | |
| 3,293,811 | 12/1966 | Rice . | |
| 3,343,808 | 9/1967 | Howlett . | |
| 3,449,876 | 6/1969 | Howlett . | |
| 3,520,032 | 7/1970 | Howlett et al. . | |
| 3,596,330 | 8/1971 | Scott | 52/223 L |
| 3,605,361 | 9/1971 | Howlett et al. . | |
| 3,646,748 | 3/1972 | Lang . | |
| 3,820,832 | 6/1974 | Brandestini et al. | 52/223 L X |
| 3,935,685 | 2/1976 | Howlett . | |
| 3,956,797 | 5/1976 | Brandestini et al. | 52/230 |
| 3,967,421 | 7/1976 | Duffossez . | |
| 4,235,055 | 11/1980 | Schambeck . | |
| 4,343,122 | 8/1982 | Wlodkowski et al. | 52/223 L |
| 4,348,844 | 9/1982 | Schupack . | |
| 4,363,462 | 12/1982 | Wlodkowski et al. | 52/230 X |

FOREIGN PATENT DOCUMENTS

| | | | |
|---|---|---|---|
| 122197 | 10/1984 | European Pat. Off. | 52/223 R |
| 2155410 | 5/1973 | Fed. Rep. of Germany | 52/223 L |
| 482080 | 1/1970 | Switzerland | 52/230 |
| 614007 | 10/1979 | Switzerland | 52/230 |

*Primary Examiner*—Alfred C. Perham

*Attorney, Agent, or Firm*—Fliesler, Dubb, Meyer & Lovejoy

[57] ABSTRACT

A protective apparatus for tendons in tendon tensioning anchoring assemblies comprising a top member, a bottom member and a sealing cap which are attached to an anchor plate for providing corrosion protection for exposed portions of a tendon anchored in the tendon tensioning anchor assembly.

14 Claims, 14 Drawing Figures

94
90
6
91
93
92
83
5
81
82
2
46
50
121

52
41
40
46
47
42
43
2
50
48
49
51
22
21
24
20
1
30
31
10
32
33
11
23
60
62
3
65
66
67
68
61
63
64
71
72
4
70

46
49
2
47
1
100
3

106
103
104
101
102
100
105

PROTECTIVE APPARATUS FOR TENDONS IN TENDON TENSIONING ANCHOR ASSEMBLIES

BACKGROUND OF THE INVENTION

1. Field of the Invention

The present invention relates to tendon tensioning anchor assemblies in general and to an apparatus for protecting from corrosion the exposed portions of the ends of a tendon held in a tendon tensioning anchor assembly in particular.

2. Description of Prior Art

Concrete structures, such as bridges, dams, buildings and the like, are frequently constructed using one or more reinforcing tendon pre- and/or post-tensioning anchor assemblies.

In a typical tendon tensioning anchor assembly there is provided a pair of spaced anchors for anchoring the ends of a tendon suspended therebetween. The tendon, particularly in a tendon post-tensioning anchor assembly installed in a concrete structure, is usually enclosed within a waterproof sheath to isolate the tendon from the surrounding concrete structure.

In the course of installing the tendon tensioning anchor assembly in a concrete structure, after stripping the waterproof sheath from a portion of both ends of the tendon to facilitate suspending the tendon between two spaced anchors, a hydraulic jack or the like is releasably attached to at least one of the exposed ends of the tendon for applying a predetermined amount of tension to the tendon. The sheath, within which the remainder of the tendon is enclosed isolates the tendon from the surrounding concrete and facilitates the movement of the tendon relative to the surrounding concrete. When the desired amount of tension is applied to the tendon, wedges, threaded nuts or the like forming a part of the anchors, are used to capture the tendon and, as the jack is removed from the tendon, to prevent its relaxation and hold it in its stressed condition.

Tendons within concrete structures may become exposed to corrosive elements, such as de-icing chemicals, sea water, brackish water, or spray from these sources, as well as salt air. If this should occur and the exposed portions of the tendon suffer corrosion, not only will the tendon be weakened due to the corrosion, but the resulting large volume of the byproducts of the corrosive reaction is often sufficient to fracture the surrounding structure. When the surrounding structure is fractured and additional corrosive elements come in contact with the tendon, premature failure of the tendon and deterioration of the structure will occur.

In U.S. Pat. No. 3,967,421 issued to Marcel Emile Duffossez on July 6, 1976, there is disclosed a bonded tendon anchor assembly comprising a plurality of tendons enclosed within a sheath. At one end thereof, the tendons are attached to a threaded tubular anchor assembly which is isolated from a surrounding concrete structure by a housing. At the point where the tendon enters the housing, there is provided a sealing joint for preventing the penetration of water and foreign bodies into a gap between the tendon and the housing. A plug is provided in the opposite end of the tubular assembly to protect grips and the ends of the tendons located therein. The opposite end of the tendon assembly is described as being left exposed to the environment.

In U.S. Pat. No. 4,348,844 issued to Morris Schupack et al on Sept. 14, 1982, there is disclosed another tendon assembly comprising a tendon enclosed in a sheath and suspended under tension between two spaced anchor members. The anchor members are entirely enclosed within an envelope or a housing. The sheath, the envelope and the housing are required to comprise electrically nonconductive materials for electrically isolating the tendon and anchor members from a surrounding concrete structure to thereby prevent the effects of corrosion caused by electrical currents.

The use of a housing or envelope which entirely encloses the anchor members in a tendon tensioning assembly as described above is expensive and if the protective housing must be installed as a separate unit in a structure, separate and apart from the anchor members, it is time consuming and costly to install. This is particularly true, since it has been found that in many structures there is little, if any, need to protect the entire anchor member or plate of a tendon assembly from corrosive elements so long as the exposed portions of the tendon itself are fully protected.

SUMMARY OF THE INVENTION

In view of the foregoing, a principal object of the present invention is an apparatus for protecting from corrosion the exposed ends of a sheathed tendon which are captured in an anchor plate of a tendon assembly.

The anchor plate comprises a base member having a planar surface. Extending from the base member there is provided a hollow tubular member having a central bore comprising a sloping annular interior wall for receiving an end of a tendon. The rim of the tubular member is beveled. Reinforcing rib members extend outwardly frm the exterior of the tubular member to the base member. Holes are provided in the base member for temporarily attaching the plate to a structure under construction and for attaching the protective apparatus of the present invention to the plate.

In accordance with the above described object of the present invention, there is provided a protective top member and a protective bottom member. In the protective top member there is provided a collar having a central bore. The diameter of the bore in the collar corresponds to the outside diameter of the tubular member in the plate. Threads are provided in an upper portion of the collar bore for receiving a threaded cap. The collar is slotted to fit over the ribs on the plate and comprises outwardly extending flange members adapted to fit between adjacent pairs of the ribs on the plate. A pair of pin members extend from one of the top and bottom members for engaging selected ones of the holes in the plate base and corresponding holes in the other protective member. The cap is provided with a beveled surface for making a watertight seal with the rim of the tubular member on the plate when it is threaded into the collar bore.

In the protective bottom member there is provided a generally rectangular main body member. Extending from the body member there is provided a hollow tubular member having a bore for receiving a tendon.

Prior to installation, the protective top and bottom members are fitted to the plate and held thereon by the pin members.

After installation of the anchor plate assembly, the end of a sheathed tendon is threaded through a predetermined distance beyond the bores in the protective bottom member, the bore in the plate and the bore in the protective top member. A hydraulic jack or the like is then used to apply tension to the tendon. When the desired amount of tension is obtained, wedge members are inserted in the plate bore to capture the tendon and prevent a relaxation of the tendon as the jack is removed from the tendon. Thereafter, the end of the tendon is trimmed below the threaded portion of the collar bore and the cap inserted to form a watertight seal with the rim of the plate. At a suitable point in the installation, a watertight seal is also made between the tendon and the tubular member extending from the protective bottom member, as by tape or the like, such that all exposed portions of the tendon are then protected from water and other corrosive elements.

BRIEF DESCRIPTION OF THE DRAWINGS

The above and other objects, features and advantages of the present invention will become apparent from the following detailed description of the accompanying drawings in which.

DETAILED DESCRIPTION OF THE DRAWINGS

Figures 1, 1A, 1B, 2, 2A:
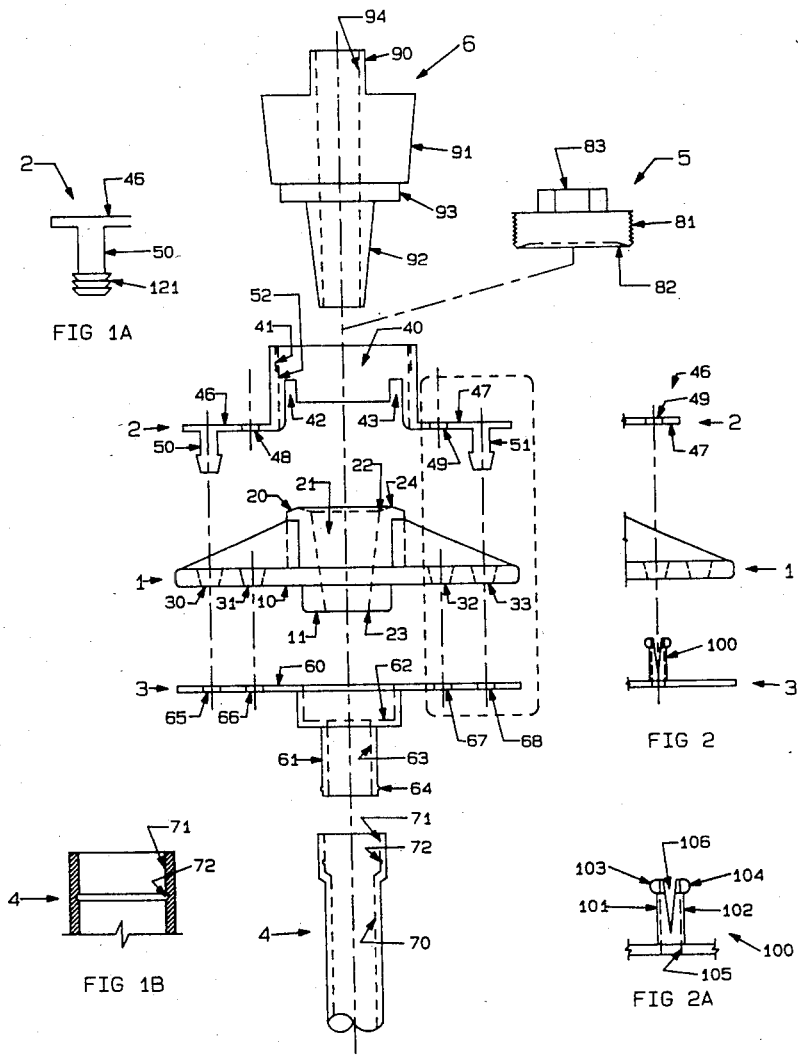
FIG. 1 is an exploded view of a protective apparatus for tendons in tendon tensioning anchor assemblies according to the present invention.
FIG. 1A is an enlarged view of one of the pin members of FIG. 1.
FIG. 1B is an enlarged view of a recess in the apparatus of FIG. 1.
FIG. 2 is a partial exploded view of a modification of the apparatus of FIG. 1.
FIG. 2A is an enlarged view of the pin member of FIG. 2.
Figure 9:
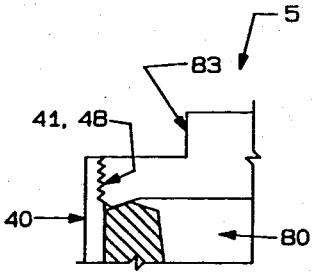
FIG. 9 is a partial cross-sectional view showing the sealing cap inserted in the collar of the top member according to the present invention.
Figure 8:
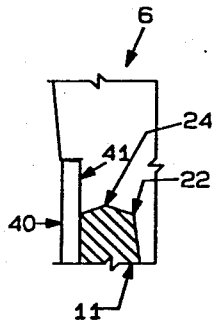
FIG. 8 is a partial cross-sectional view showing a grommet inserted in the top and anchor plate members according to the present invention.
Figure 5:
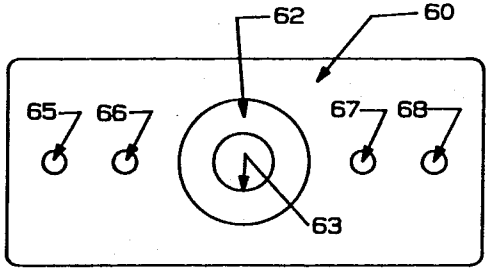
FIG. 5 is a plan view of a bottom member according to the present invention.
Figure 3:
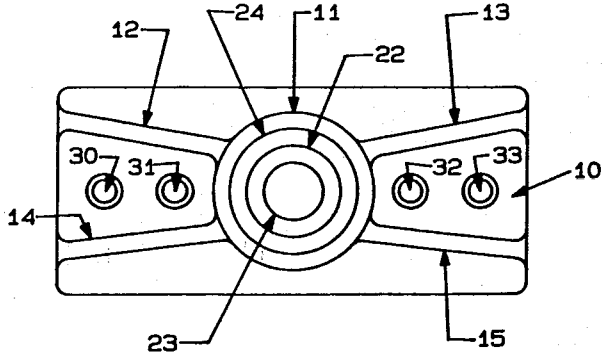
FIG. 3 is a top plan view of a tendon tensioning anchor member with which the apparatus of the present invention is used.
Figure 4:
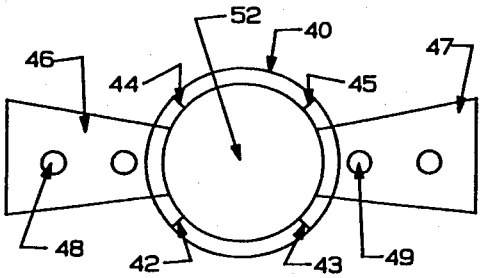
FIG. 4 is a plan view of a top member according to the present invention.

Referring to FIGS. 1–9 there is provided in accordance with the present invention for use with a conventional tendon tensioning anchor plate designated generally as 1, a protective top member designated generally as 2, a protective bottom member designated generally as 3, an auxiliary tubular member designated as 4, a sealing cap designated generally as 5 and a grommet designated generally as 6.

In plate 1, there is provided a plate base member 10. Extending from the upper and lower surfaces of the base plate member 10, there is provided a tubular member 11. Extending between an upper exterior wall surface of the tubular member 11 and the upper surface of the base plate 10 there is provided a plurality of reinforcing rib members 12, 13, 14, and 15. On the top edge of the member 11 there is provided an annular beveled surface 20. In the interior of the member 11 there is provided an inwardly sloping bore 21 having an upper edge 22 and a lower edge 23. The top edge of the beveled surface 20 is designated 24. Located between adjacent pairs of the ribs 12–15 there is provided a plurality of holes 30, 31, 32 and 33.

In top member 2 there is provided a collar 40. In an upper portion of a collar 40 there is provided internal threads 41. Below the threads 41 there is provided a plurality of slots 42 43 44 and 45. Extending outwardly from a lower edge of the collar 40 there is provided a plurality of flange members 46 and 47. In the flange members 46 and 47 there is provided a plurality of holes 48 and 49. Extending downwardly from the flange members 46 and 47 there is provided a plurality of pin members 50 and 51. In the center of the collar 40 there is provided a bore 52. The diameter of the bore 52 corresponds to the outside diameter of the tubular member 11 for providing a close fit between the collar 40 and the tubular member 11 when the member 2 is fitted over the plate 1. The slots 42–45 in the collar 40 provide a clearance for the rib members 12–15 when the member 2 is fitted on the plate 1.

In one embodiment of the present invention there is provided at the lower end of the pins 50 and 51, as shown in the enlarged view of pin 50 in FIG. 1A, a plurality of outwardly extending teeth 121.

In the bottom member 3 there is provided a rectangularly-shaped plate member 60. Extending from the plate member 60 there is provided a tubular member 61. At the upper end of the tubular member 61 there is provided a cavity 62 for receiving the lower end of the tubular member 11 of the plate 1. Extending downwardly from the cavity 62 there is provided a centrally located bore 63. Located near the lower end of the tubular member 61 there is provided an annular protrusion 64. In the rectangular plate member 60 there is provided a plurality of holes 65, 66, 67 and 68.

In the tubular member 4 there is provided a centrally located bore 70 having at its upper end an enlarged portion 71. In the wall of the enlarged portion 71 there is provided an annular recess 72, as shown more clearly in an enlarged view thereof in FIG. 1B. The recess 72 is provided for receiving the protrusion 64 in the tubular member 61 for coupling the tubular member 4 to the tubular member 61 in a telescoping watertight fashion.

Figure 6:
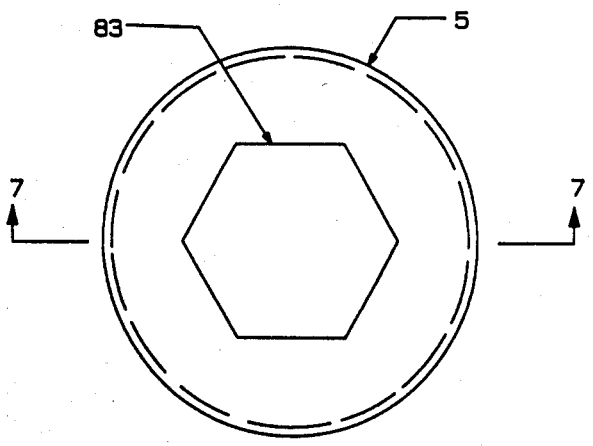
FIG. 6 is a plan view of a sealing cap according to the present invention.
Figure 7:
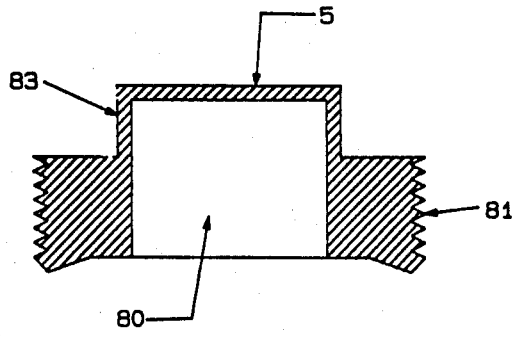
FIG. 7 is a cross-sectional view of the cap of FIG. 6 taken in the direction of lines 7—7.

Referring to FIGS. 6 and 7 there is provided in the sealing cap member 5 an interior centrally located cavity 80. Extending around the periphery of the cap member 5 there is provided a plurality of threads 81. In the lower surface of the cap member 5 there is provided a beveled surface 82. The beveled surface 82 corresponds to the beveled surface 20 at the top of the tubular member 11 of the plate 1 for forming a watertight seal therewith. On the upper surface of the cap 5 there is provided hexagonal nut shaped protrusion 83. As further described below, the protrusion 83 is provided for facilitating the insertion and removal of the cap 5 into and from the collar 40 of the top member 2.

In the grommet 6 there is provided a plurality of truncated annular coned-shaped sections 90, 91 and 92. Located between sections 91 and 92 there is provided an annular cylindrically shaped section 93. Centrally located in the sections 90–93 there is provided a bore 94.

Referring to FIGS. 2 and 2A, in an alternative embodiment of the present invention, the base member 46 of the plate 2 is foreshortened to exclude the portion carrying the pins 50 and 51 of the embodiment of FIG. 1. In the bottom member 3 there is provided in the place of holes 66 and 67 of the embodiment of FIG. 1 a pin member 100. As shown more clearly in FIG. 2A, pin member 100 comprises a first section 101 and a second section 102. At the upper ends of the sections 101 and 102 there is provided an annular protrusion 103 and 104. Extending through the pin member 100 there is provided a centrally located nail receiving bore 105. The sections 101 and 102 are split as shown at 106 to enable the sections 101 and 102 to be pressed together and thereafter expand, as will be further described below, when the bottom and top members 2 and 3 are attached to the plate 1.

Figure 10:
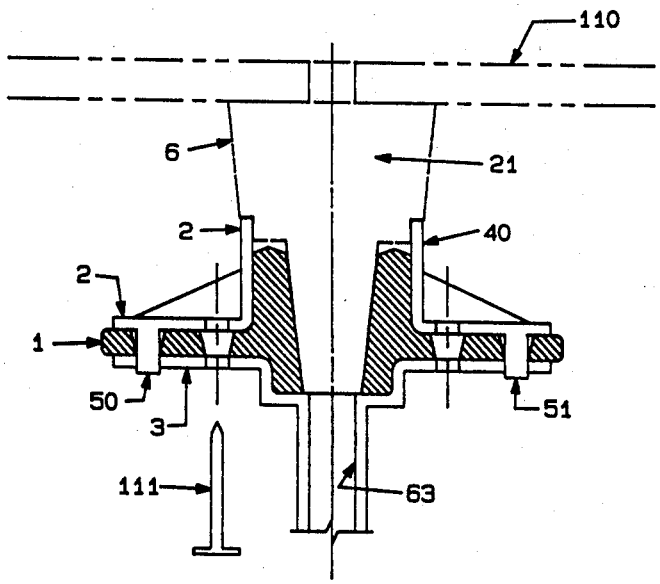
FIG. 10 is a cross-sectional view showing the grommet of FIG. 1 being used in connection with the apparatus of the present invention.
Figure 11:
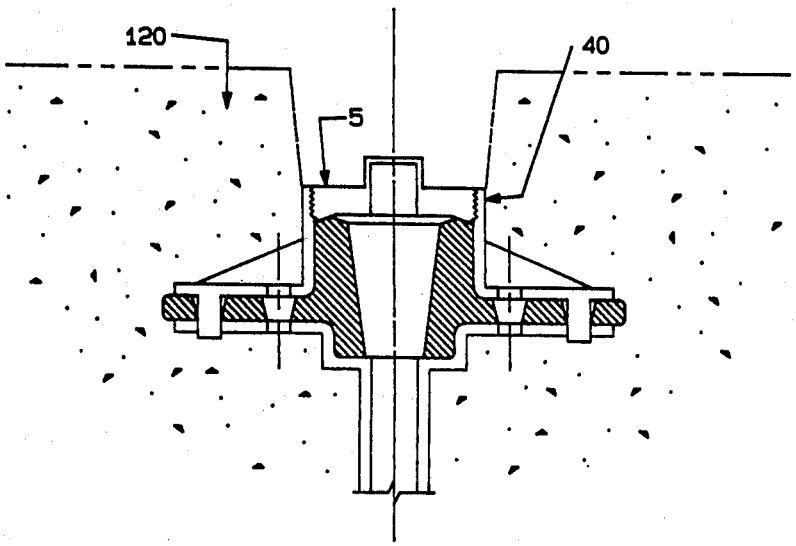
FIG. 11 is a cross-sectional view of the apparatus according to the present invention installed in a concrete structure.

Referring to FIGS. 10 and 11, before the tendon tensioning anchor assembly of the present invention is installed in a concrete structure, the top and bottom members 2 and 3 are attached to the plate 1. This accomplished by inserting the pin members 50 and 51 of the embodiment of FIG. 1 through holes 30 and 33 in the plate 1 and holes 65 and 68 in the bottom member 3. After the pins 50 and 51 are inserted through the holes 65 and 68 in the bottom member 3 the outwardly extending teeth 121 of the pins 50 and 51 engage the undersurface of the plate member 60 of the bottom member 3 for locking the members 2 and 3 to the plate 1. The pin members 100 in the embodiment of FIGS. 2 and 2A function in substantially the same manner.

In FIG. 10 there is shown in phantom lines a form member 110 which is used like other form members in the construction of concrete structures for containing concrete until it cures. After the top and bottom members 2 and 3 are attached to the plate 1, the grommet 6 is inserted in the collar 40 of the top member 2 temporarily for closing the collar as shown in more detail in FIG. 8. The assembly is thereafter nailed to the form 110 by means of a nail 111. The end of a tendon from which the sheath has been removed, the opposite end of which has been anchored to a distant structure, is then threaded through the bore 63 of the lower member 3, the bore 21 of the plate 1, through the collar 40 of the top member 2 and the bore 94 of the grommet 6 such that an exposed portion of the tendon extends beyond the form 110 through a hole 112 therein.

Referring to FIG. 11 after the tendon is inserted through the bores in the plate 1, top and bottom members 2 and 3 and grommet 6 as described above, a watertight seal is formed, as by tape, between the tendon and the tubular member 61 of the bottom member 3. Concrete 120 is then poured about the assembly. After the concrete 120 has cured, the form 110 and grommet 6 are removed. A hydraulic jack or the like is then attached to the free end of the tendon and a predetermined amount of tension is applied to the tendon. After the predetermined amount of tension is applied to the tendon, wedge members or the like which are inserted in the bore 21 of the plate 1 engage the tendon. As the jack is removed from the tendon the wedge shaped members capture the tendon and prevent its relaxation. Thereafter the tendon is trimmed adjacent to the top of the tubular member 11 of the plate 1 and the sealing cap 5 is inserted in the collar 40 so as to form a watertight seal between the beveled surface 82 of the cap 5 and the beveled surface 20 at the top of tubular member 11 of the plate 1.

Since the sheath of the remainder of the tendon provides a watertight barrier, the sealing of the tendon to the tubular member 61 and the protection provided by the cap 5 totally encloses the exposed end of the tendon thereby preventing the tendon from coming into contact with water and other corrosive elements.

As indicated above, the opposite end of the tendon is anchored in a similar manner, however, in the process of anchoring the opposite end of the tendon it is generally necessary to strip an excess portion of the sheath from the tendon to permit its attachment to the anchor. In order to cover the exposed portion of the tendon from which the sheath is removed the tubular member 4 provides a watertight extension for covering the exposed end of the tendon. The length of the tubular member 4 may very depending upon the amount of exposed tendon that is required to be covered. Of course, all exposed portions of the tendon are protected from water and corrosive elements in the manner described above.

While a preferred and several alternatives embodiments of the present invention are described above, it is contemplated that various modifications may be made thereto without departing from the spirit and scope of the present invention. For this reason it is intended that the above described embodiments be considered only as illustrating the present invention and that scope thereof be determined by reference to the claims hereinafter provided.

What is claimed is:

1. A protective apparatus for protecting an exposed end of a tendon in a tendon tensioning anchor plate having a base member and a tubular member extending from said base member with a central bore located therein, comprising:

a top member having a collar with a central bore located therein, said central bore of said collar having a predetermined inside diameter for permitting said collar to be closely fitted over and around said tubular member of said anchor plate;

means insertable within said collar for covering one end of said bore in said tubular member in said plate in a watertight fashion;

a bottom member having a hollow tubular member extending therefrom with a central bore located therein for use in forming a watertight seal with a tendon inserted therein; and means insertable through a hole in said base member of said anchor plate for attaching said top and bottom members together with said anchor plate located therebetween.

2. An apparatus according to claim 1 wherein said collar comprises interior threads and said covering means comprises exterior threads for mating with said interior threads in said collar, a cavity for providing a clearance space for an end of said tendon and an annular beveled surface for mating with a facing beveled surface on said tubular member of said anchor plate in a watertight fashion.

3. An apparatus according to claim 2 wherein said covering means comprises a nut-shaped extension for facilitating the insertion in and removal of said covering means into and from said collar.

4. An apparatus according to claim 1 wherein said collar comprises a plurality of slots for receiving a plurality of rib members on said anchor plate.

5. An apparatus according to claim 4 wherein a first one of said top and bottom members comprises holes and said top member comprises a flange member which extends outwardly from a lower edge of said collar and is adapted to rest on a top surface of said plate between an adjacent pair of said rib members and said attaching means comprises a locking pin member which extends from a second one of said top and bottom members for insertion in said holes in said first one of said top and bottom members in a locking manner.

6. An apparatus according to claim 1 wherein a first one of said top and bottom members comprises a plurality of holes and said attaching means comprises a plurality of locking pin members which extend from the other of said top and bottom members for insertion in selected ones of said holes in said first one of said top and bottom members.

7. An apparatus according to claim 6 wherein said pin member comprises a pair of split members with a means located on an end thereof for engaging in a locking manner said first one of said top and bottom members when said pin member is inserted in said holes.

8. An apparatus according to claim 7 wherein said pin member comprises a nail receiving bore and said locking means comprises a radially extending protrusion.

9. An apparatus according to claim 5 wherein said pin members extend from said top member.

10. An apparatus according to claim 5 wherein said pin members extend from said bottom member.

11. An apparatus according to claim 1 comprising a tubular member having a central bore and means for coupling said latter tubular member to said tubular member which extends from said bottom member.

12. A protective apparatus for protecting an exposed end of a tendon in a tendon tensioning anchor plate member having a base member, a tubular member extending from said base member with a central bore located therein and a top having an annular beveled surface thereon, a plurality of reinforcing rib members which extend between said tubular member and said base member and a plurality of holes located in said base member between adjacent pairs of said rib members, comprising:

a top member adapted to fit on said plate member having a collar, a pair of flange members extending from a lower edge of said collar adapted to fit between adjacent pairs of said rib members, a plurality of holes in said flange members, a bore in said collar having a predetermined inside diameter for permitting said collar to be closely fitted over and around said tubular member of said anchor plate member, threads located inside said collar for removably receiving a sealing cap and slots located in said collar for providing a clearance for said rib members when said top member is fitted on said plate member;

a sealing cap having threads, an annular beveled surface for making a watertight seal with said beveled surface on said top of said tubular member, a means for facilitating an insertion and a removal of said sealing cap into and from said collar and a cavity for providing clearance for an end of a tendon;

a bottom member having a plate member, a tubular member extending from said latter plate member having a bore for receiving a tendon and a plurality of holes in said latter plate member; and means for attaching said top and bottom members to a top and bottom surface of said anchor plate member.

13. An apparatus according to claim 12 wherein said attaching means comprising locking pin members which extend from a first one of said top and bottom members and which are adapted to be inserted through selected ones of said holes in said plate member for engaging in a locking manner selected holes in the other of said top and bottom members.

14. A protective apparatus for protecting an exposed end of a tendon in a tendon tensioning anchor plate having a base member and a tubular member extending from said base member with a central bore located therein, comprising:

a top member having a collar with a central bore located therein, said central bore of said collar having a predetermined inside diameter for permitting said collar to be closely fitted over and around said tubular member of said anchor plate;

means insertable within said collar for covering one end of said bore in said tubular member in said plate in a watertight fashion;

a bottom member having a hollow tubular member extending therefrom with a central bore located therein for use in forming a watertight seal with a tendon inserted therein; and a resilient locking member for resiliently locking said top and said bottom members to each other with said anchor plate located therebetween.

* * * * *